US007798290B2

(12) United States Patent
Mustalahti et al.

(10) Patent No.: US 7,798,290 B2
(45) Date of Patent: Sep. 21, 2010

(54) ARRANGEMENT IN AN ELEVATOR WITHOUT COUNTERWEIGHT

(75) Inventors: Jorma Mustalahti, Hyvinkää (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 80 days.

(21) Appl. No.: 12/338,795

(22) Filed: Dec. 18, 2008

(65) Prior Publication Data

US 2009/0120733 A1 May 14, 2009

Related U.S. Application Data

(63) Continuation of application No. PCT/FI2007/000168, filed on Jun. 14, 2007.

(30) Foreign Application Priority Data

Jun. 28, 2006 (FI) ..... 20060627

(51) Int. Cl.
*B66B 1/34* (2006.01)

(52) U.S. Cl. ..... 187/391; 187/264

(58) Field of Classification Search ..... 187/247, 187/251, 254, 264, 266, 277, 289, 391–393, 187/411, 412
See application file for complete search history.

(56) References Cited

U.S. PATENT DOCUMENTS 3,407,904 A * 10/1968 Trollope ..... 187/289
5,788,018 A 8/1998 Mendelsohn et al.
6,193,017 B1 2/2001 Köster
7,207,421 B2 * 4/2007 Aulanko et al. ..... 187/266
2004/0000795 A1 1/2004 Shen
2009/0314584 A1 * 12/2009 Smith et al. ..... 187/247

FOREIGN PATENT DOCUMENTS

| | | | |
|---|---|---|---|
| CN | 1764591 | A | 4/2006 |
| EP | 1798184 | A | 6/2007 |
| JP | 2004-067365 | A | 3/2004 |
| WO | WO 2004/067429 | A1 | 8/2004 |
| WO | WO 2004/094287 | A2 | 11/2004 |
| WO | WO 2006/038299 | A1 | 4/2006 |

* cited by examiner

*Primary Examiner*—Jonathan Salata
(74) *Attorney, Agent, or Firm*—Birch, Stewart, Kolasch & Birch, LLP

(57) ABSTRACT

The present invention relates to an arrangement in an elevator without counterweight, which comprises at least a control unit (5), a hoisting machine (3) and a traction sheave (4) connected to it, and an elevator car (1) suspended on hoisting ropes (2) fixed to an essentially immovable place at their first ends and adjustably at their second ends, which elevator car (1) is fitted to travel backwards and forwards in an essentially vertical direction, and which elevator also comprises a tightening element (15) acting on the second end of the hoisting ropes (2). An actively operating actuator (17, 21, 24, 29) is in connection with the tightening element (15), which is fitted by means of feedback to keep the rope tension essentially at a predetermined level either by lightening or tightening the rope tension according to changes in the loading.

20 Claims, 4 Drawing Sheets

ARRANGEMENT IN AN ELEVATOR WITHOUT COUNTERWEIGHT

Figure 1:
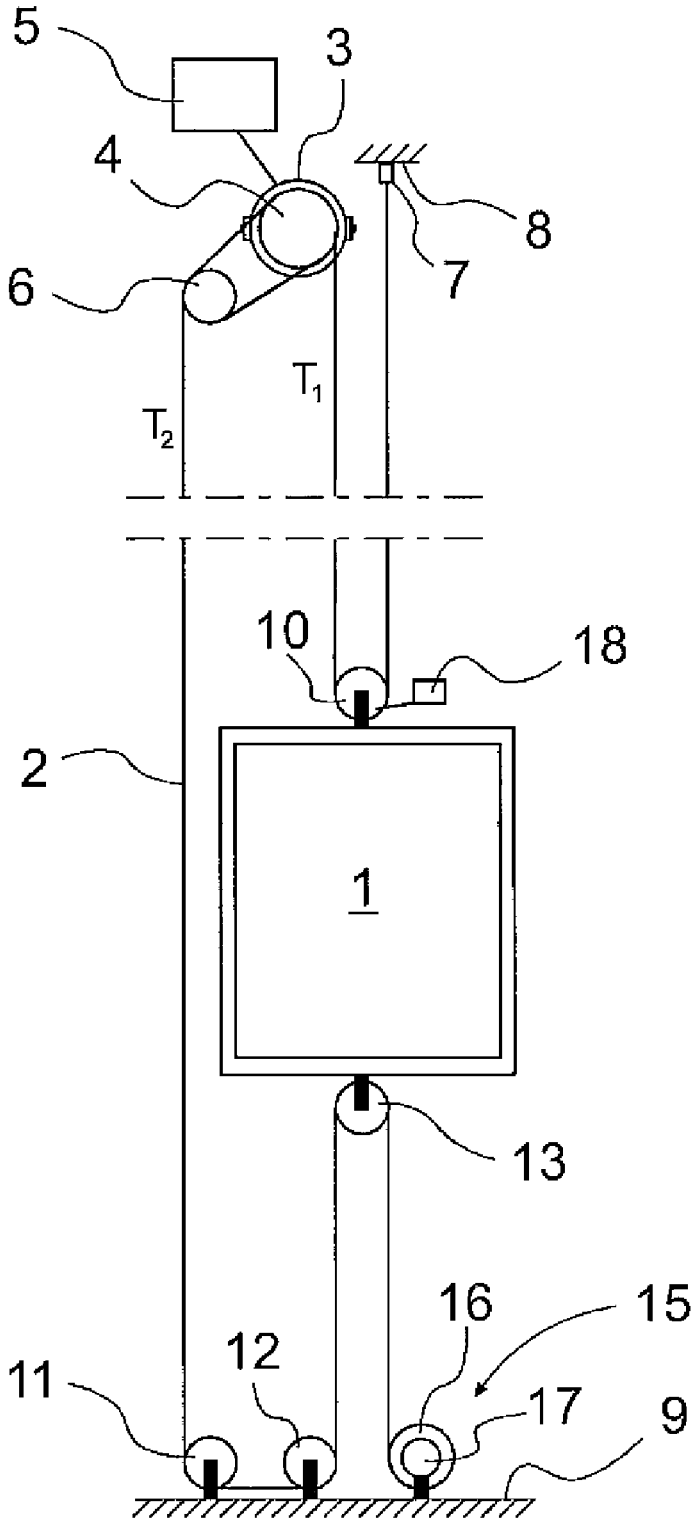

This application is a Continuation of copending PCT International Application No. PCT/FI2007/000168 filed on Jun. 14, 2007, which designated the United States, and on which priority is claimed under 35 U.S.C. §120. This application also claims priority under 35 U.S.C. §119(a) on Patent Application No(s). 20060627 filed in Finland on Jun. 28, 2006, all of which are hereby expressly incorporated by reference into the present application.

The present invention relates to an arrangement in an elevator without counterweight as defined in the preamble of claim 1.

In traction sheave elevators the elevator car is moved by means of a traction sheave and hoisting ropes. In place of hoisting ropes, hoisting belts or other similar hoisting elements can also be used. In the following, any reference to hoisting ropes refers to all hoisting elements suited to the purpose.

In order for movement of the elevator car to operate in the manner planned, there must be sufficient friction between the rope grooves of the traction sheave and the hoisting ropes, in which case the ropes do not slip on the traction sheave. One prior art solution is the use of a moving counterweight, which always moves simultaneously with the elevator car but in the opposite direction. A problem when using a counterweight is the shaft space required by at least the counterweight, which generally takes up space in the shaft through the whole length of the shaft. This space is expensive and especially in high-rise buildings the total space required by the counterweight is very large. Another problem is the installation, servicing and material costs of the counterweight and the structures connected to it, such as the guide rails.

Elevators without counterweight, in which the shaft space saved as a result of eliminating the counterweight is used e.g. to increase the floor area of the building or to enable elevator cars that are larger in terms of their floor area, have been developed to overcome the above-mentioned problem.

However, a problem in elevators without counterweight is determining the correct friction for all loading situations. For this reason the friction in elevators without counterweight is maintained by keeping the hoisting ropes always at a certain tension. The necessary tension or tightness is maintained in prior art passively, either with additional weights of standard magnitudes or with springs, which are generally fixed to one of the ends of the hoisting ropes. For safety reasons the aforementioned tension must be calculated according to the maximum load, because the hoisting ropes must be capable of not slipping on the traction sheave even with maximum load. A suitable safety margin must then be added to the maximum load, in which case the rope tension must in practice always be kept greater than the maximum load by the amount of the safety margin. Since an elevator is seldom driven with maximum load, however, the tension in the solutions described above is frequently too great. This causes e.g. faster wearing in the hoisting ropes and in the rope grooves of the rope pulleys.

One prior art arrangement in an elevator without counterweight is presented in international patent number WO2004/094287. In this arrangement the rope tension is maintained with a tension element, in which according to one embodiment a counterweight is placed at the lower end of the rope, the mass of which is set during installation to the desired magnitude and which counterweight stays essentially stationary when the elevator moves. Other embodiments presented include springs or hydraulic cylinders disposed at the ends of the hoisting ropes. Since the tension of the rope is not in any way measured in this solution, the tension achieved by the tightening element must be calculated according to the maximum load, to which a safety margin must still be added. Thus there are also the same problems in this solution as presented earlier.

The purpose of this invention is to eliminate the aforementioned drawbacks and to achieve a reliable arrangement in an elevator without counterweight, in which arrangement the tension of the hoisting ropes of the elevator is measured and by means of feedback the tension of the hoisting ropes can be kept in all loading situations at a magnitude just sufficient for maintaining the necessary friction. The arrangement of the invention is characterized by what is disclosed in the characterization part of claim 1. Likewise other embodiments of the invention are characterized by what is disclosed in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments.

One advantage of the solution according to the invention is that the elevator is safe for users in all operating situations. Another advantage is that it is not needed to unnecessarily maintain tension dimensioned for the maximum load in the hoisting roping, in which case wearing of at least the rope pulleys and the ropes is less than in solutions dimensioned according to maximum load. In addition dimensioning of the ropes can be better optimized, in which case it is possible to use thinner rope or e.g. one rope less than in prior art solutions. A further advantage is that the ratio of the rope tension on both sides of the traction sheave can be kept essentially constant, in which case no excess loadings occur in any location of the suspension.

In practice, with the invention rope tension is maintained that is of a sufficient magnitude, taking into account a suitable safety margin, to prevent the rope slipping on the traction sheave. The need to maintain rope tension can depend also on the function or state of motion of the elevator, as well as or instead of on the loading, or on a combination of these. For example, when accelerating the elevator car the rope tension can be increased during the acceleration, in which case the normal force exerted on the traction sheave of the hoisting rope increases and simultaneously the grip of the traction sheave on the hoisting rope improves. Likewise when braking the elevator the rope tension can be increased via braking of the traction sheave.

Figure 2:
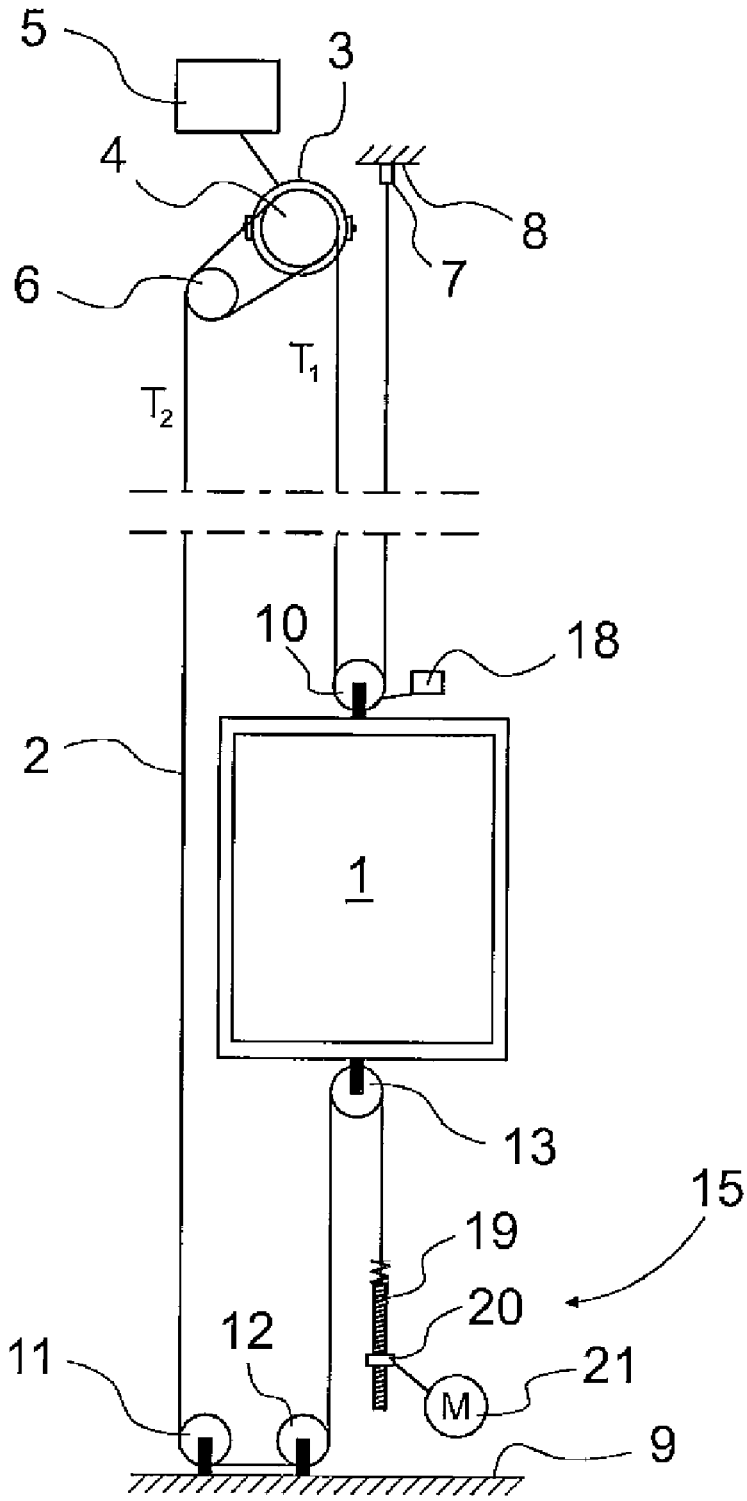
Figure 3:
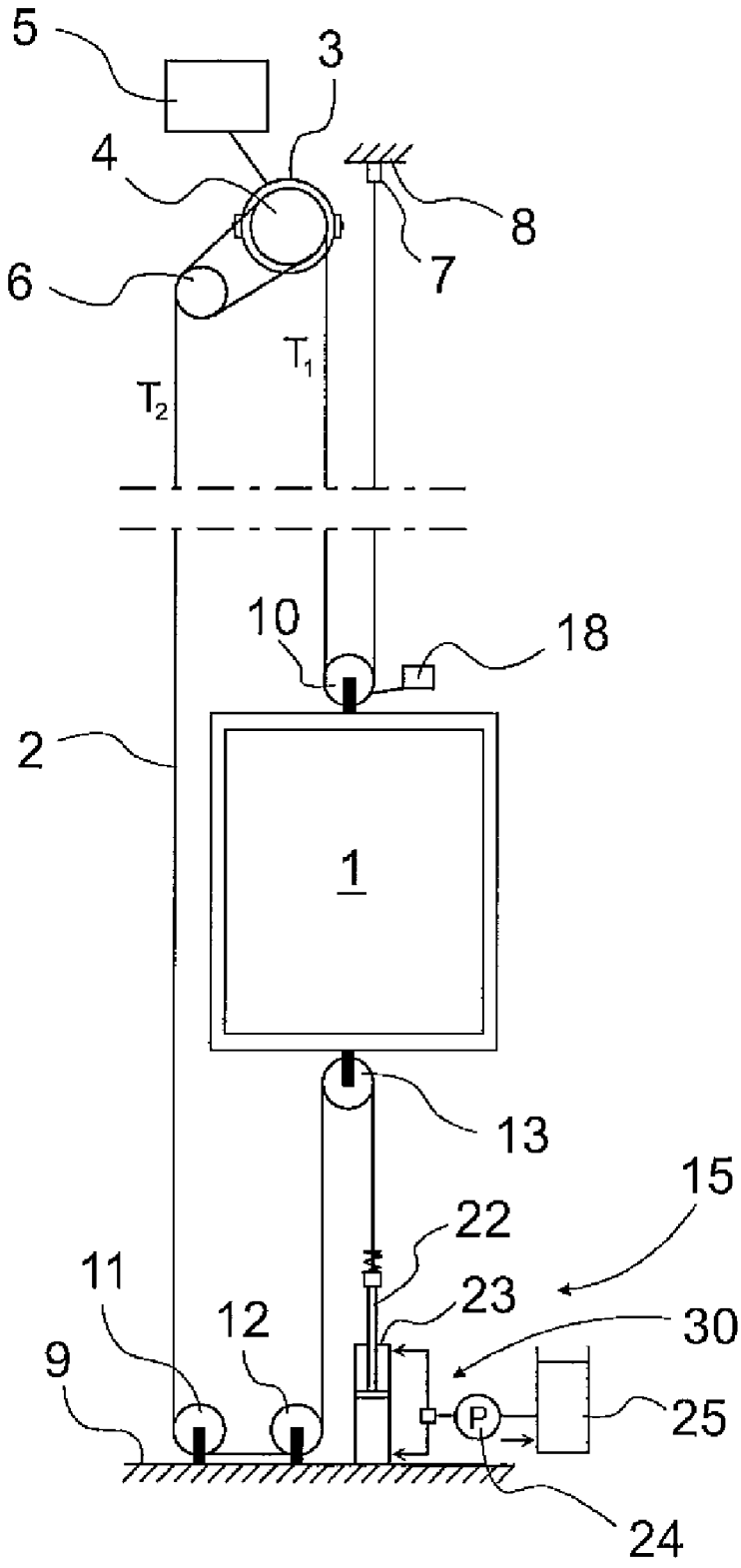
Figure 4:
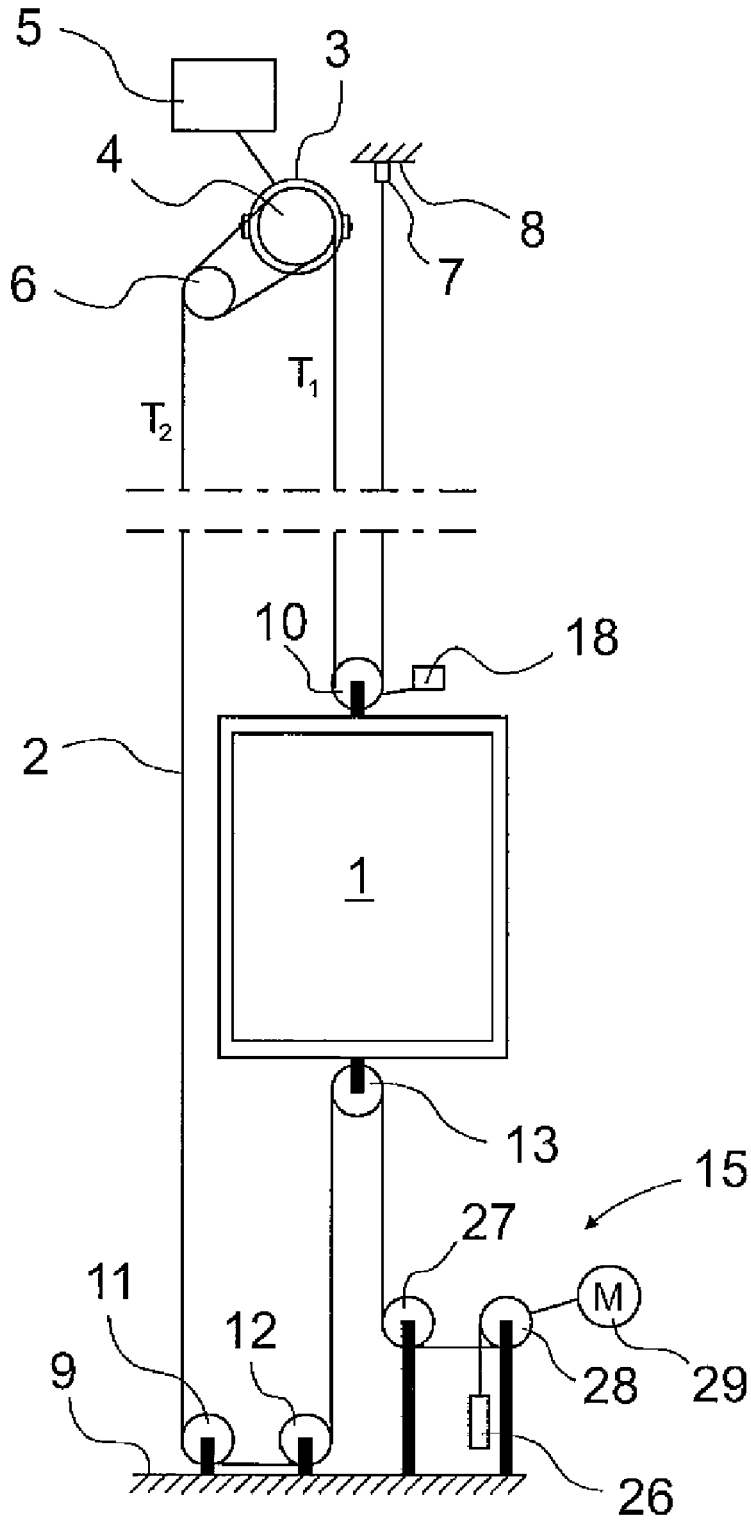

The invention will be described in the following in more detail by the aid of two examples of its embodiments with reference to the attached drawings, wherein FIG. 1 presents a simplified and diagrammatic side view of an elevator solution, in which one embodiment according to the invention is used, FIG. 2 presents a simplified and diagrammatic side view of an elevator solution, in which a second embodiment according to the invention is used, FIG. 3 presents a simplified and diagrammatic side view of an elevator solution, in which a third embodiment according to the invention is used and FIG. 4 presents a simplified and diagrammatic side view of an elevator solution, in which a fourth embodiment according to the invention is used.

FIG. 1 presents a simplified and diagrammatic side view of a typical traction sheave elevator, in which one embodiment according to the invention is used. The elevator is preferably an elevator provided with a control unit 5, in which the elevator car 1, the hoisting roping formed of parallel hoisting ropes 2, and the hoisting machine 3 with its traction sheave 4 are disposed in the elevator shaft. The hoisting machine 3 with its traction sheave can also be outside the shaft. The elevator receives its lifting force from the hoisting machine 3 as a result of the friction between the traction sheave 4 and the hoisting ropes 2.

In the roping solution presented in FIG. 1 each hoisting rope 2 is fixed at its first end to be essentially immovable to a fixed point 7 in the upper part 8 of the elevator shaft. From their fixing points 7 the hoisting ropes 2 are led to pass downwards to one or more diverting pulleys 10 on the elevator car 1, after passing around the bottom of which the hoisting ropes 2 are led upwards to the traction sheave 4 of the hoisting machine 3. In order to achieve the greatest possible angle of contact between the traction sheave 4 and the hoisting ropes 2, in the proximity of the traction sheave 4 is a diverting pulley 6, around which the rope led from around the top of the traction sheave 4 is led back to the traction sheave 4. After passing over the traction sheave 4 a second time the hoisting ropes 2 are led over the diverting pulley 6 under the diverting pulley 11 in the proximity of the bottom end 9 of the elevator shaft and then under the second diverting pulley 12 in the proximity of the bottom end 9 of the elevator shaft and after passing around the diverting pulley 12 the hoisting ropes 2 are led upwards towards the diverting pulley 13 disposed below the elevator car 1 and that moves with the elevator car 1. After passing around the top of the diverting pulley 13 the hoisting ropes 2 are led further downwards to the active tightening element 15 of the hoisting rope disposed in the proximity of the bottom end 9 of the elevator shaft, to which the second ends of the hoisting ropes 2 are adjustably fixed. Adjustably means here that the tension of the hoisting ropes 2 is changed, i.e. tightened or lightened by moving the second ends of the hoisting ropes 2.

The arrangement also comprises at least a car load weighing device, one or more tension sensors or other similar measuring appliance 18, which has a feedback connection at least to the active hoisting rope tightening element 15 controlled by some control element, e.g. the control unit 5 of the elevator, and from the measuring data received from which measuring appliance 18 the rope tension at the time in the hoisting ropes 2 is determined essentially in real-time by means of the aforementioned control element. The measuring appliance 18 is presented in the figures diagrammatically and above the car, in connection with the diverting pulley 10 that moves with the car. The measuring appliance 18 can however be disposed in many different places. Likewise when the car load weighing device functions as the aforementioned measuring appliance, the car load weighing device can be disposed in any place at all that is suited to the purpose. When the measuring appliance 18 is in connection with the elevator car or near the fixing point 7 of the first end of the hoisting ropes 2, the rope tension measured receives the value $T_1$. Correspondingly, when the measuring appliance 18 is near the fixing point of the second end of the hoisting ropes 2, i.e. the active tightening element 15 of the hoisting rope, the rope tension measured receives the value $T_2$.

The structural solutions presented in FIGS. 1-4 are essentially alike but they differ from each other mainly with respect to the structure of the active tightening element 15 of the hoisting rope.

In the solution according to FIG. 1 the active tightening element 15 of the hoisting rope comprises at least a tightening drum 16 and an actuator 17, such as an electric motor or other suitable actuator, that rotates the drum and is controlled by a control element. Feedback about the measurement data of the measuring appliance 18 is connected to the actuator 17 via a control element, such as the control unit 5 of the elevator. The second ends of the hoisting ropes 2 are fixed to the tightening drum 16 and the actuator 17 is fitted to exert torque on the tightening drum 16, which keeps the tension $T_1$ of the hoisting ropes 2 essentially at a pre-defined value or in a value range based on the measurement data received from the measuring appliance 18. In this case the actuator 17 is fitted if necessary to either increase or decrease the tension of the hoisting ropes 2 according to changes in the loading.

Correspondingly in the solution according to a second embodiment of the invention presented in FIG. 2 the active tightening element 15 of the hoisting rope comprises at least one thread element 19 provided with an external thread, which hereinafter is referred to as a screw, and a thread element 20 or similar element provided with an internal thread, hereinafter referred to as a nut, fitted to rotate on the screw and locked to be essentially immovable in the vertical direction. In addition, the tightening element 15 comprises in this embodiment an actuator 21, such as an electric motor or other suitable actuator, that rotates the nut 20. Feedback about the measurement data of the measuring appliance 18 is connected to the actuator 21 via a control element, such as the control unit 5 of the elevator. The second ends of the hoisting ropes 2 are fixed to the first end of the screw 19, which in the case shown in the figure is the upper end of the screw and the actuator 21 is fitted to exert torque on the nut 20, which rotates the nut 20 and thus moves the screw 19 in the vertical direction and thereby keeps the tension $T_1$ of the hoisting ropes 2 essentially at a pre-defined value based on the measuring data received from the measuring appliance 18. In this solution also the actuator 21 is fitted if necessary to either increase or decrease the tension of the hoisting ropes 2 according to changes in the loading.

In the solution according to a third embodiment of the invention presented in FIG. 3 the active tightening element of the hoisting rope comprises at least one power cylinder, which can be e.g. a hydraulic cylinder 23 provided with a piston 22. In addition the tightening element 15 in this embodiment comprises an actuator 24, such as a pump with flow channeling 30 and a fluid reservoir 25, that moves the piston 22 in the hydraulic cylinder backwards and forwards in essentially the longitudinal direction of the elevator ropes. The flow channeling comprises e.g. the necessary inflow channels and outflow channels as well as valves. Feedback about the measurement data of the measuring appliance 18 is connected to the actuator 24 via a control element, such as the control unit 5 of the elevator. The second ends of the hoisting ropes 2 are fixed to the top end of the rod of the piston 22 and the actuator 24 is fitted to move the piston 22 in the hydraulic cylinder 23 and thus to keep the tension $T_1$ of the hoisting ropes 2 essentially at a pre-defined value based on the measurement data received from the measuring appliance 18. In this solution also the actuator 21 is fitted if necessary to either increase or decrease the tension of the hoisting ropes 2 according to changes in the loading.

FIG. 4 presents yet another solution for actively keeping the tension of the hoisting ropes 2 at that desired. In this solution the active tightening element 15 of the hoisting rope comprises at least a counterweight 26 as well a first diverting pulley 27 and a second diverting pulley 28, which diverting pulleys are disposed near the bottom end 9 of the elevator shaft. The hoisting ropes 2 are led from the diverting pulley 13 disposed below the elevator car 1 to pass below the first diverting pulley 27 and further under the second diverting pulley 28 and then after passing around the top of the diverting pulley 28 the second ends of the hoisting ropes 2 are fixed to the counterweight 26, the mass of which is determined according to the maximum load of the elevator with the aforementioned safety margin then added. It is also possible to implement the solution without the first diverting pulley 27, in which case the angle of contact of the hoisting ropes 2 on the rim of the second diverting pulley 28 is essentially 90° greater than in the solution presented here. In addition, the tightening element in this embodiment comprises an actuator 29, such as an electric motor or other suitable actuator, that rotates the second diverting pulley 28. Feedback about the measurement data of the measuring appliance 18 is connected to the actuator 29 via a control element, such as the control unit of the elevator. The actuator 29 is fitted to exert torque on the diverting pulley 28, which if necessary rotates the diverting pulley 28 against the torque produced by the counterweight 26 and thus keeps the tension of the hoisting ropes 2 essentially at a pre-defined value based on the measurement data received from the measuring appliance 18. In this solution the counterweight 26 is fitted to increase the tension of the hoisting ropes and the actuator 29 is fitted if necessary to decrease the tension of the hoisting ropes 2, either more or less, according to changes in the loading. An advantage of this solution is, among other things, safety e.g. in connection with an electrical power cut, because the counterweight 26 is determined according to the maximum load and a safety margin. During a power cut the lightening of the actuator 29 does not function, in which case tightening of the rope is as great as possible and slipping on the traction sheave 4 is not able to occur even with large loads.

In the arrangement according to the invention the hoisting ropes 2 are tightened or lightened actively by means of feedback such that the rope tension remains essentially at a predefined level in all loading conditions. In this case the rope tension is kept always either essentially constant or in a certain, pre-defined range. In that case also the friction acting on the traction sheave 4 between the hoisting ropes 2 and the rope grooves of the traction sheave 4 remains in all loading situations essentially constant or in a certain, pre-defined range. Likewise the ratio $T_1/T_2$ of the rope tensions on different sides of the traction sheave 4 remains in all loading situations essentially constant or in a certain, pre-defined range. For the rope suspension to operate in the desired manner, the ratio of the rope tensions $T_1/T_2$ must be greater than one, i.e. $T_1/T_2>1$.

It is obvious to the person skilled in the art that the invention is not limited solely to the examples described above, but that it may be varied within the scope of the claims presented below. Thus, for instance, rope tension can be measured otherwise than by means of load weighing information or from the proximity of the first ends of the hoisting ropes. One method of measuring rope tension is to measure e.g. the tension difference on different sides of the traction sheave. On the side of the first ends of the ropes the rope tension is the aforementioned $T_1$ and correspondingly on the side of the second ends of the ropes the rope tension is $T_2$. A feedback value for the difference between the tensions $T_1-T_2$ or for the ratio $T_1/T_2$ is determined for the active tightening element of the hoisting rope. The measuring appliance is in this case e.g. strain gauges, or other similar sensors that measure tension, disposed in the proximity of the ends of the hoisting ropes.

It is further obvious to the person skilled in the art that the active tightening element of the hoisting rope can also be different to what is described above. The idea is to measure rope tension and to arrange feedback from the measurement of rope tension to an active tightening element, which is fitted to keep rope tension essentially at the magnitude of a predefined level in all loading situations, on the basis of the measurement data.

It is further obvious to the person skilled in the art that the control element of the tightening element can be something other than a control element connected to the control unit of the elevator. The control element can be disposed either in connection with the measuring appliance, in connection with the tightening element or it can be an entirely separate unit, which is connected both to the measuring appliance and to the tightening element. The control element contains at least means for processing measurement data and for sending control data to the tightening element.

It is further obvious to the person skilled in the art that the invention can also be used just as well with other rope suspensions than with the 2:1 suspension presented in the figures. Likewise the positioning and structure of the hoisting machine of the elevator as well as the number of diverting pulleys can be different to that presented above.

The invention claimed is:

1. Arrangement in an elevator without counterweight, which elevator comprises at least a control unit, a hoisting machine and a traction sheave connected to it, as well as an elevator car suspended on hoisting ropes that are fixed to an essentially immovable place at their first end and adjustably at their second end, which elevator car is fitted to travel backwards and forwards in an essentially vertical direction, and which elevator also comprises a tightening element acting on the second end of the hoisting ropes, wherein an actively operating actuator is in connection with the tightening element, which actuator is fitted by means of information detected in the elevator or by means of the control data of the elevator to change at least one rope tension ($T_1$, $T_2$) and/or to keep the ratio of the rope tensions ($T_1/T_2$) above the elevator car and below the elevator car essentially at a predetermined level either by lightening or tightening the rope tension according to changes in the loading.

2. Arrangement according to claim 1, wherein information about loading is fed back to the control of the magnitude of rope tension.

3. Arrangement according to claim 1, wherein the feedback information arranged to the actuator is the load weighing information of a measuring appliance, such as a car load weighing device, that measures the loading of the elevator.

4. Arrangement according to claim 1, wherein the feedback information arranged to the actuator is the tension information of the tension of the hoisting ropes of the elevator measured with a measuring appliance.

5. Arrangement according to claim 1, wherein the feedback information arranged to the actuator is feedback information determined from the difference between rope tensions $T_1-T_2$ or from the ratio $T_1/T_2$ measured on different sides of the traction sheave.

6. Arrangement according to claim 1, wherein the active tightening element of the hoisting rope comprises at least one drum, to which the second ends of the hoisting ropes are fixed, and in that an actuator is fitted to rotate the drum, to which essentially real-time feedback information about the tension of the hoisting ropes in the loading situation at the time is arranged.

7. Arrangement according to claim 1, wherein the active tightening element of the hoisting rope comprises at least one thread element provided with an external thread, such as a screw, to the first end of which the second ends of the hoisting ropes are fixed, and on which screw a thread element provided with an internal thread, such as a nut or similar element, is fitted to rotate, which nut is locked to be immovable in the vertical direction, and in that the tightening element comprises an actuator fitted to rotate the nut, such as an electric motor or other suitable actuator, to which actuator essentially real-time feedback information about the tension of the hoisting ropes in the loading situation at the time is arranged.

8. Arrangement according to claim 1, wherein the active tightening element of the hoisting rope comprises a power unit provided with at least one cylinder, a piston moving in the cylinder, flow channeling, a pump acting as an actuator that moves the cylinder, and a pressure medium reservoir, and in that essentially real-time feedback information about the tension of the hoisting ropes in the loading situation at the time is arranged to the actuator.

9. Arrangement according to claim 1, wherein the active tightening element of the hoisting rope comprises at least a counterweight and at least one diverting pulley, around the bottom of which diverting pulley the second ends of the hoisting ropes are led, and to which second ends of the hoisting ropes the counterweight is fixed, and in that the tightening element comprises an actuator, such as an electric motor or other suitable actuator, fitted to rotate the diverting pulley, to which actuator essentially real-time feedback information about the tension of the hoisting ropes in the loading situation at the time is arranged, and in that the actuator is fitted to lighten the tightening caused by the counterweight.

10. Arrangement according to claim 1, wherein the control data for the tightening element is the function status and/or motion status.

11. Arrangement according to claim 1, wherein the ratio ($T_1$/T2) of the rope tensions ($T_1$, $T_2$) is constant.

12. Arrangement according to claim 2, wherein the feedback information arranged to the actuator is the load weighing information of a measuring appliance, such as a car load weighing device, that measures the loading of the elevator.

13. Arrangement according to claim 2, wherein the feedback information arranged to the actuator is the tension information of the tension of the hoisting ropes of the elevator measured with a measuring appliance.

14. Arrangement according to claim 2, wherein the feedback information arranged to the actuator is feedback information determined from the difference between rope tensions $T_1$-$T_2$ or from the ratio $T_1/T_2$ measured on different sides of the traction sheave.

15. Arrangement according to claim 2, wherein the active tightening element of the hoisting rope comprises at least one drum, to which the second ends of the hoisting ropes are fixed, and in that an actuator is fitted to rotate the drum, to which essentially real-time feedback information about the tension of the hoisting ropes in the loading situation at the time is arranged.

16. Arrangement according to claim 3, wherein, wherein the active tightening element of the hoisting rope comprises at least one drum, to which the second ends of the hoisting ropes are fixed, and in that an actuator is fitted to rotate the drum, to which essentially real-time feedback information about the tension of the hoisting ropes in the loading situation at the time is arranged.

17. Arrangement according to claim 4, wherein, wherein the active tightening element of the hoisting rope comprises at least one drum, to which the second ends of the hoisting ropes are fixed, and in that an actuator is fitted to rotate the drum, to which essentially real-time feedback information about the tension of the hoisting ropes in the loading situation at the time is arranged.

18. Arrangement according to claim 5, wherein the active tightening element of the hoisting rope comprises at least one drum, to which the second ends of the hoisting ropes are fixed, and in that an actuator is fitted to rotate the drum, to which essentially real-time feedback information about the tension of the hoisting ropes in the loading situation at the time is arranged.

19. Arrangement according to claim 2, wherein the active tightening element of the hoisting rope comprises at least one thread element provided with an external thread, such as a screw, to the first end of which the second ends of the hoisting ropes are fixed, and on which screw a thread element provided with an internal thread, such as a nut or similar element, is fitted to rotate, which nut is locked to be immovable in the vertical direction, and in that the tightening element comprises an actuator fitted to rotate the nut, such as an electric motor or other suitable actuator, to which actuator essentially real-time feedback information about the tension of the hoisting ropes in the loading situation at the time is arranged.

20. Arrangement according to claim 3, wherein the active tightening element of the hoisting rope comprises at least one thread element provided with an external thread, such as a screw, to the first end of which the second ends of the hoisting ropes are fixed, and on which screw a thread element provided with an internal thread, such as a nut or similar element, is fitted to rotate, which nut is locked to be immovable in the vertical direction, and in that the tightening element comprises an actuator fitted to rotate the nut, such as an electric motor or other suitable actuator, to which actuator essentially real-time feedback information about the tension of the hoisting ropes in the loading situation at the time is arranged.

* * * * *